US011369218B2

(12) United States Patent
Gutschke

(10) Patent No.: US 11,369,218 B2
(45) Date of Patent: Jun. 28, 2022

(54) MODULAR MIRROR MOUNTING SYSTEM

(71) Applicant: Kevin Scott Gutschke, Montgomery, TX (US)

(72) Inventor: Kevin Scott Gutschke, Montgomery, TX (US)

( * ) Notice: Subject to any disclaimer, the term of this patent is extended or adjusted under 35 U.S.C. 154(b) by 0 days.

(21) Appl. No.: 17/123,530

(22) Filed: Dec. 16, 2020

(65) Prior Publication Data

US 2021/0219749 A1 Jul. 22, 2021

Related U.S. Application Data

(60) Provisional application No. 62/964,348, filed on Jan. 22, 2020.

(51) Int. Cl.
*A47G 1/16* (2006.01)
*A47G 1/06* (2006.01)

(52) U.S. Cl.
CPC ..... *A47G 1/166* (2013.01); *A47G 1/06* (2013.01); *A47G 1/16* (2013.01); *A47G 1/1606* (2013.01)

(58) Field of Classification Search
CPC ..... A47G 1/16; A47G 1/1606; A47G 1/065; A47G 1/20; A47G 1/24; A47G 1/06; A47G 1/1686; A47G 1/0605; A47G 1/166; A47G 1/1633; A47G 1/162; A47G 1/142; A47G 1/0694
USPC .... 248/466, 477, 475.1, 476, 488, 489, 490, 248/495, 496, 497, 498, 470, 473
See application file for complete search history.

(56) References Cited

U.S. PATENT DOCUMENTS 366,989 A * 7/1887 Witthoeft, Jr. ..... A47G 1/24 248/493
1,357,280 A * 11/1920 Dulle ..... A47G 1/1686 248/490
1,398,869 A * 11/1921 Le Roy ..... E06B 9/52 49/389
1,421,301 A * 6/1922 Petrow ..... A47G 1/08 40/741
1,832,248 A * 11/1931 Henryg ..... A47G 1/24 356/397
1,842,285 A * 1/1932 Place ..... A47G 1/06 40/781
2,204,862 A * 6/1940 Lehman ..... A47G 1/215 248/466
2,263,629 A * 11/1941 Jacoby ..... A47G 1/065 40/730
2,357,819 A * 9/1944 Royden ..... G09F 7/00 160/351

(Continued)

*Primary Examiner* — Nkeisha Smith
(74) *Attorney, Agent, or Firm* — Boudwin Intellectual Property; Daniel Boudwin

(57) ABSTRACT

A modular mirror mounting system is shown and described. The modular mirror mounting system includes a modular mirror frame. The modular mirror frame is comprised of a first cross support secured to a plurality of elongated supports. The plurality of elongated supports extends from a first connected end in the same direction away from the first cross support. A second cross support is secured to a second end of each of the plurality of elongated supports. A plurality of mounting apertures is located through the supports. The modular mirror frame has a mirror secured to the frame, wherein the mirror has a plurality of apertures therethrough. The mirror is secured via mirror fasteners placed through the apertures of the mirror and the frame.

10 Claims, 5 Drawing Sheets

(56) References Cited

U.S. PATENT DOCUMENTS 2,819,549 A * 1/1958 Jefferson ..... A47G 1/08 40/739
2,907,537 A * 10/1959 Mapson ..... G09F 7/18 248/477
3,236,481 A * 2/1966 Howard ..... E01F 9/696 248/475.1
3,329,105 A * 7/1967 McPherson ..... A47B 37/00 108/4
3,583,466 A * 6/1971 Dreyer ..... G03B 21/58 160/351
3,687,524 A 8/1972 Martinez
3,792,917 A * 2/1974 Martinez ..... A47G 1/02 359/881
3,830,278 A * 8/1974 Packer ..... B44D 3/185 160/378
3,837,754 A * 9/1974 Malcik ..... B42F 15/0088 403/217
4,138,083 A * 2/1979 Spiegel ..... A47G 1/24 248/474
4,269,382 A * 5/1981 Coulson ..... A47G 1/02 248/472
4,312,086 A * 1/1982 Bianco ..... A47B 83/00 108/108
4,519,151 A * 5/1985 Johnson ..... B44D 3/185 160/374.1
4,729,183 A * 3/1988 Tarter ..... A47G 1/0605 40/766
4,761,902 A * 8/1988 Lansky ..... A47G 1/17 40/605
4,821,438 A * 4/1989 Lansky ..... A47G 1/17 40/759
4,934,858 A * 6/1990 Beaulieu ..... F16B 12/40 403/174
5,015,084 A * 5/1991 Kryder ..... A63B 24/0003 248/469
5,124,858 A * 6/1992 Goetz ..... G02B 7/1824 248/469
5,292,189 A * 3/1994 Lau ..... H05K 7/183 312/265.3
5,557,870 A * 9/1996 Bergman ..... B65D 85/182 160/372
5,624,118 A * 4/1997 Gottesman ..... A63F 9/1044 273/157 R
6,065,843 A 5/2000 Martinez
6,449,863 B1 * 9/2002 Voorhees ..... A47G 1/205 248/495
6,684,518 B2 * 2/2004 Voorhees ..... A47G 1/205 248/495
7,866,074 B2 * 1/2011 McComb ..... B43L 1/08 40/606.01
8,074,387 B2 * 12/2011 Mancuso ..... G09F 13/04 40/564
8,596,600 B2 * 12/2013 Spencer ..... B43L 1/00 248/447.1
8,959,817 B1 * 2/2015 Barnes ..... A47G 1/06 40/711
9,110,362 B2 * 8/2015 Risher ..... G03B 21/56
9,119,487 B2 * 9/2015 Angvall ..... A47F 7/24
9,687,091 B2 * 6/2017 Jhagroo ..... A47G 1/065
10,039,392 B2 * 8/2018 Servutas ..... A47G 1/102
10,388,197 B2 * 8/2019 Tuttle ..... G09F 7/18
10,786,098 B1 * 9/2020 Martin ..... G01B 5/25
10,974,352 B1 * 4/2021 Klinger ..... A47B 47/027
2005/0160652 A1 * 7/2005 Moody ..... A63H 33/086 40/741
2009/0218470 A1 * 9/2009 Zlotocha ..... A47G 1/16 248/478
2009/0250422 A1 10/2009 Clark et al.
2014/0237875 A1 * 8/2014 Randall ..... G09F 1/10 40/797
2014/0362602 A1 * 12/2014 Hofman ..... E04B 2/7863 362/612
2017/0367504 A1 * 12/2017 Servutas ..... G09F 15/00
2018/0014664 A1 * 1/2018 Tabo ..... A47G 1/0627
2018/0042406 A1 * 2/2018 Fields ..... A47G 1/0605
2020/0397159 A1 * 12/2020 Haney ..... A47G 1/06

* cited by examiner

MODULAR MIRROR MOUNTING SYSTEM

CROSS REFERENCE TO RELATED APPLICATIONS

This application claims the benefit of U.S. Provisional Application No. 62/964,348 filed on Jan. 22, 2020. The above identified patent application is herein incorporated by reference in its entirety to provide continuity of disclosure.

BACKGROUND OF THE INVENTION

The present invention relates to a modular mirror mounting system. More particularly, the present invention provides a system for transporting and installing acrylic, glass, and mylar mirrors.

Many individuals have difficulty installing mirrors in their homes or businesses, particularly when changing traditional glass mirrors for acrylic mirrors. These mirrors can be difficult to install and transport. These mirrors often times must be installed in a manner different from traditional mirrors. Further, often times these mirrors are difficult to connect together for different applications. This means that often times one large mirror is needed. This can be extremely difficult to transport and install safely.

Consequently, there is a need for an improvement in the art of installing glass, mylar, and acrylic mirrors. The present invention substantially diverges in design elements from the known art while at the same time solves a problem many people face when moving and installing glass, mylar, and acrylic mirrors. In this regard the present invention substantially fulfills these needs.

SUMMARY OF THE INVENTION

The present invention provides a modular mirror mounting system wherein the same can be utilized for providing convenience for the user when transporting or installing an acrylic, glass, or mylar mirror. The modular mirror frame is comprised of a first cross support secured to a plurality of elongated supports. The plurality of elongated supports extends from a first connected end in the same direction away from the first cross support. A second cross support is secured to a second end of each of the plurality of elongated supports. A plurality of mounting apertures is located through the supports.

Another object of the modular mirror frame is to have a mirror secured to the frame. The mirror has a plurality of apertures therethrough. The mirror is secured via mirror fasteners placed through the apertures of the mirror and the frame.

Another object of the modular mirror frame is to have at least one additional cross support secured to the elongated supports between the first cross support and the second cross support.

Another object of the modular mirror frame is to have each of the supports have a rectangular cross section.

Another object of the modular mirror frame is to have each of the supports have an interior volume.

Another object of the modular mirror frame is to have the supports have a rectangular cross section.

Another object of the modular mirror frame is to have the apertures located through both an upper side and a lower side of the supports.

Another object of the modular mirror frame is to have the apertures located through the upper side of the supports are threaded apertures.

Another object of the modular mirror frame is to have the supports removably secured together with fasteners.

Another object of the modular mirror frame is to have the mirror fasteners be threaded and correspond with the threaded apertures of the frame.

Another object of the modular mirror frame is to have a plurality of wheels secured to the first cross support.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
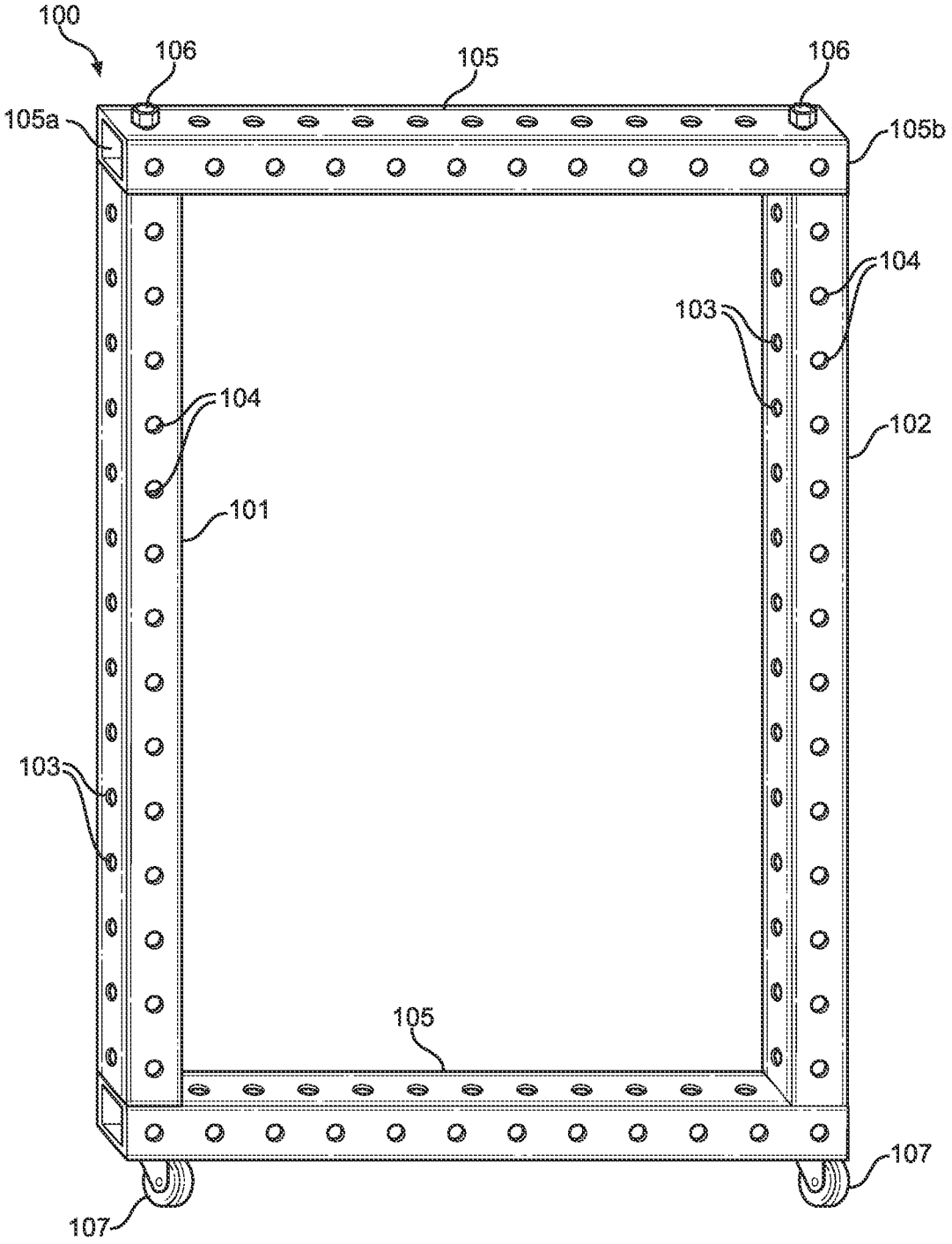
FIG. 1 shows a front view of an embodiment for a frame of the modular mirror mounting system.

Reference is made herein to the attached drawings. Like reference numerals are used throughout the drawings to depict like or similar elements of the modular mirror mounting system. For the purposes of presenting a brief and clear description of the present invention, a preferred embodiment will be discussed as used for the modular mirror mounting system. The figures are intended for representative purposes only and should not be considered to be limiting in any respect.

Referring now to FIG. 1, there is shown a front view of an embodiment for a frame of the modular mirror mounting system. The modular mirror mounting system includes a mounting bracket 100. The mounting bracket 100 includes a first support bar 101 and a second support bar 102. In one embodiment each of the support bars 101, 102 have a rectangular cross section. In a further embodiment each of the support bars 101, 102 includes a hollow interior. There is a first plurality of apertures 103 through at least one side of each support 101, 102. In another embodiment there is a second plurality of apertures 104 located along a side of each of the supports 101, 102 adjacent to the side with the first plurality of apertures 103. In one embodiment the first plurality of apertures 103 and the second plurality of apertures 104 are disposed at equal lengths of the supports 101, 102 such that each of the first and second pluralities of apertures 103, 104 align with each other.

The mounting bracket 100 further includes a pair of cross supports 105. In one embodiment the pair of cross supports 105 are each removably secured to the first support 101 and the second support 102. A fastener 106 will secure a first end 105*a* of each of the pair of cross supports 105 along the length of the first support 101. Another fastener 106 will secure a second end 105*b* of each of the pair of cross supports 105 along a length of the second support 102. This will allow for the mounting bracket 100 to be formed into an appropriate size to fit a mirror thereon.

In one embodiment there are at least two wheels 107 secured to the mounting bracket 100. In one embodiment the at least two wheels 107 are casters. In another embodiment the at least two wheels 107 are rubber wheels. In one embodiment the at least two wheels 107 are secured to one of the pair of cross supports 105. In another embodiment the at least two wheels 107 are secured to lower ends of the first support 101 and the second support 102. In the illustrated embodiment, the pair of cross supports 105 are affixed at the terminal ends of each of the first and second supports 101, 102, however, in alternate embodiments, the pair of cross supports 105 are disposed between the first and second supports 101, 102, such that the terminal ends thereof are exposed.

Figure 2:
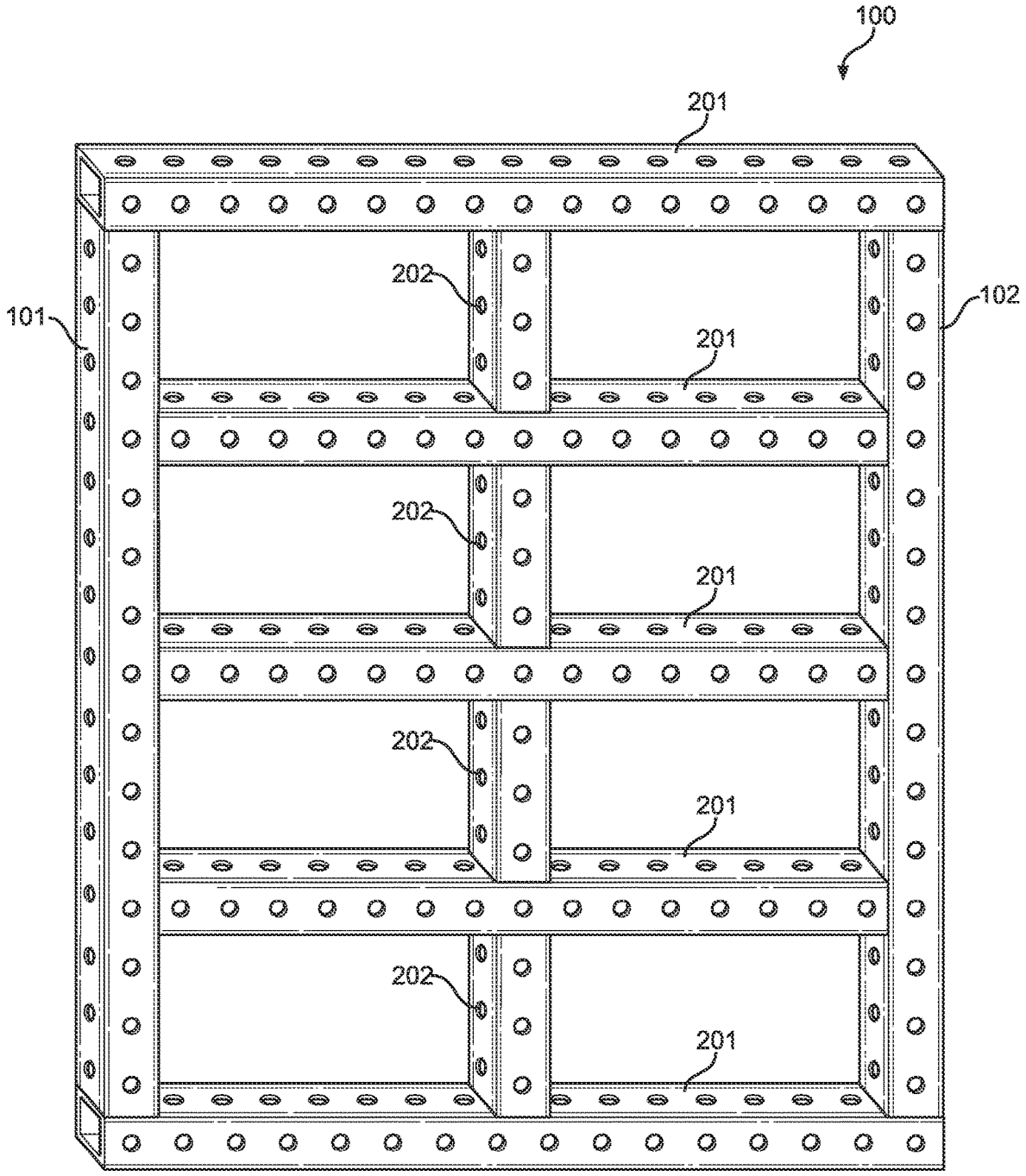
FIG. 2 shows a front view of an alternative embodiment of a frame for the modular mirror mounting system.

Referring now to FIG. 2, there is shown a front view of an alternative embodiment of a frame for the modular mirror mounting system. In one embodiment the mounting bracket 100 includes a first support 101 and a second support 102 as described above. In this embodiment there is a multitude of cross supports 201. In one embodiment each of the cross supports 201 are secured to the first support 101 at one end and the second support 102 at a second end. In one embodiment the cross supports 201 are welded to the first support 101 and the second support 102. In a further embodiment there is at least one additional support 202. The additional support 202 will fit between at least two of the cross supports 201.

Figure 3:
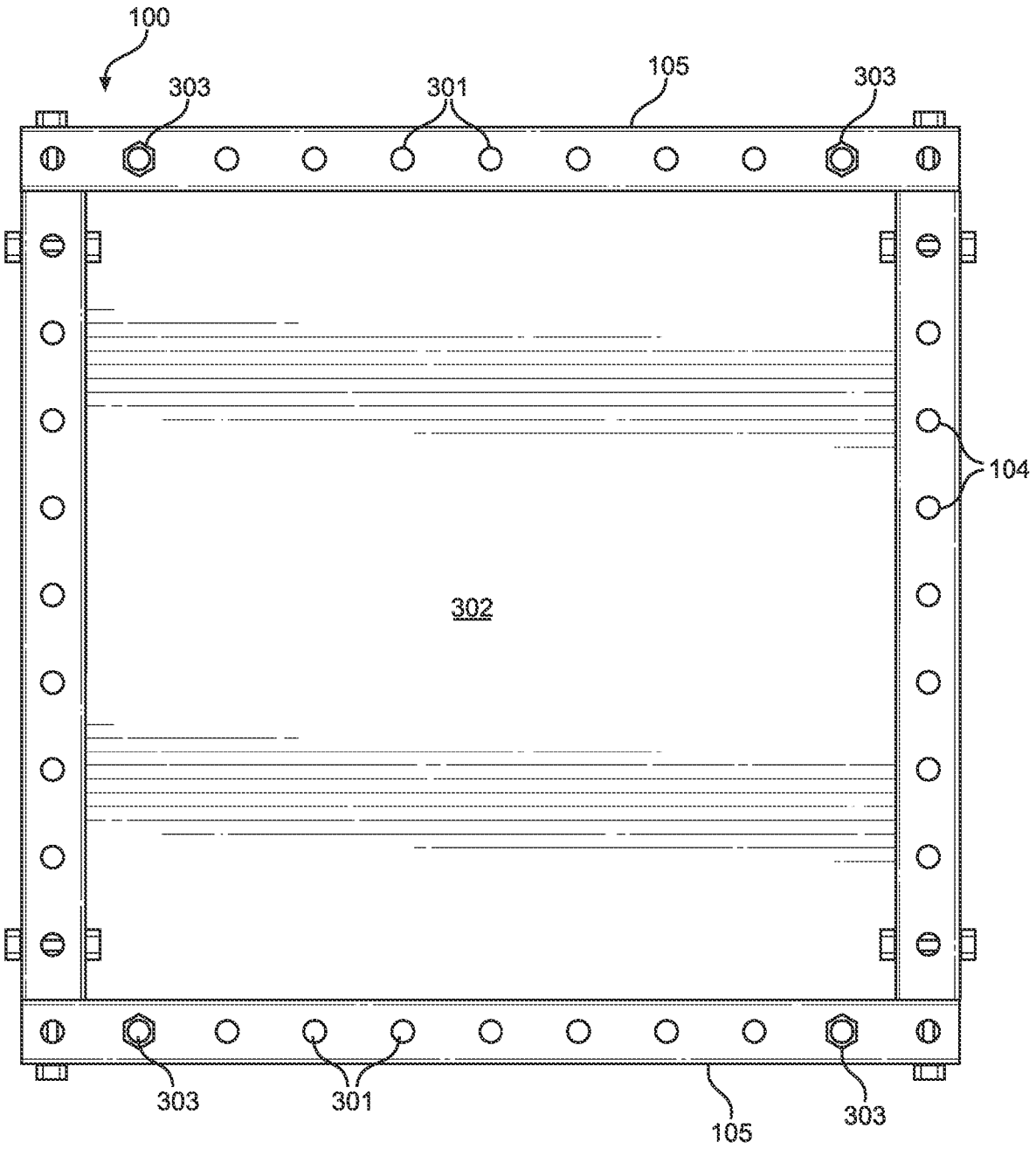
FIG. 3 shows a rear view of an embodiment of the frame for the modular mirror mounting system.

Referring now to FIG. 3, there is shown a rear view of an embodiment of the frame for the modular mirror mounting system. From the rear the second plurality of apertures 104 can be seen through a side of the first support 101 and the second support 102. Further, a plurality of apertures 301 can be seen through each of the pair of cross supports 105. In one embodiment the apertures 104, 301 are used to secure the mounting bracket 100 to a surface. In one embodiment the apertures 104, 301 will have a connector placed therein. The connector will hold the mounting bracket 100 in place.

There is further shown a mirror 302 secured to the front side of the mounting bracket 100. There is shown fasteners 303 secured through the mounting bracket 100. The fasteners will allow for the mirror 302 to be mounted in different locations along the mounting bracket 100. Further, in different embodiments multiple mirrors may be secured to a single mounting bracket 100. The mirror 302 can comprise a glass, mylar, or acrylic construction to accommodate a user's preferences.

Figure 4:
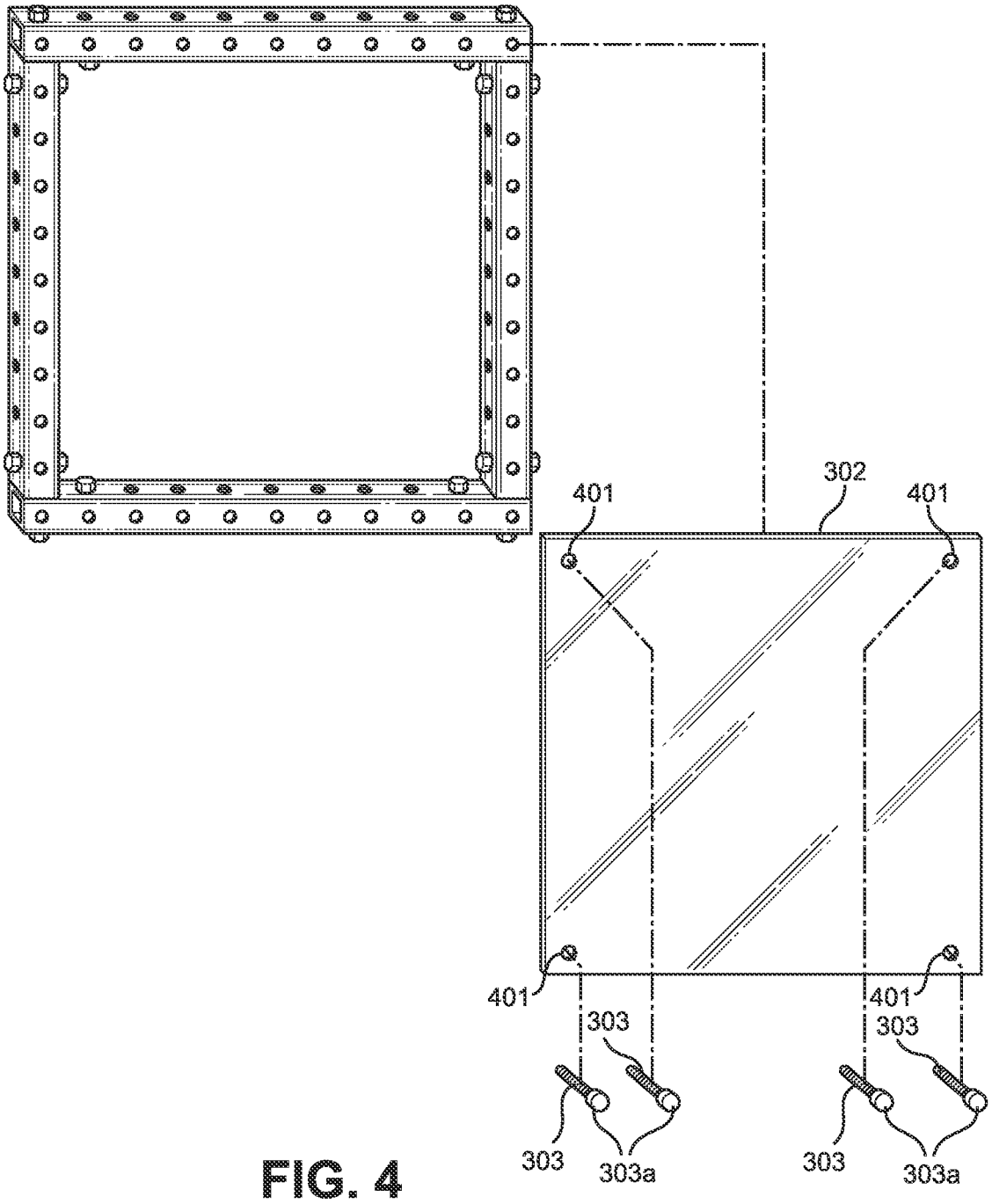
FIG. 4 shows an exploded view of an embodiment of the modular mirror mounting system.

Referring now to FIG. 4, there is shown an exploded view of an embodiment of the modular mirror mounting system. The mirror 302 has a plurality of apertures 401. In one embodiment the apertures 401 are located about the perimeter of the mirror 302. The apertures 401 will allow fasteners 303 to be placed therethrough. In one embodiment the fasteners 303 are threaded fasteners. In one embodiment the fasteners 303 are placed through the mirror 302 and the mounting bracket 100, a securement device is then attached to the end of the fastener 303, this will hold the mirror 302 in place.

In another embodiment the apertures located in the mounting bracket 100 are threaded apertures. This will allow the fasteners 303 to secure directly to the mounting bracket 100. In one embodiment the fasteners 303 have a decorative grasping end 303*a*. This will allow the fasteners 303 to not only be grasped but also to have an aesthetic appeal.

Figure 5:
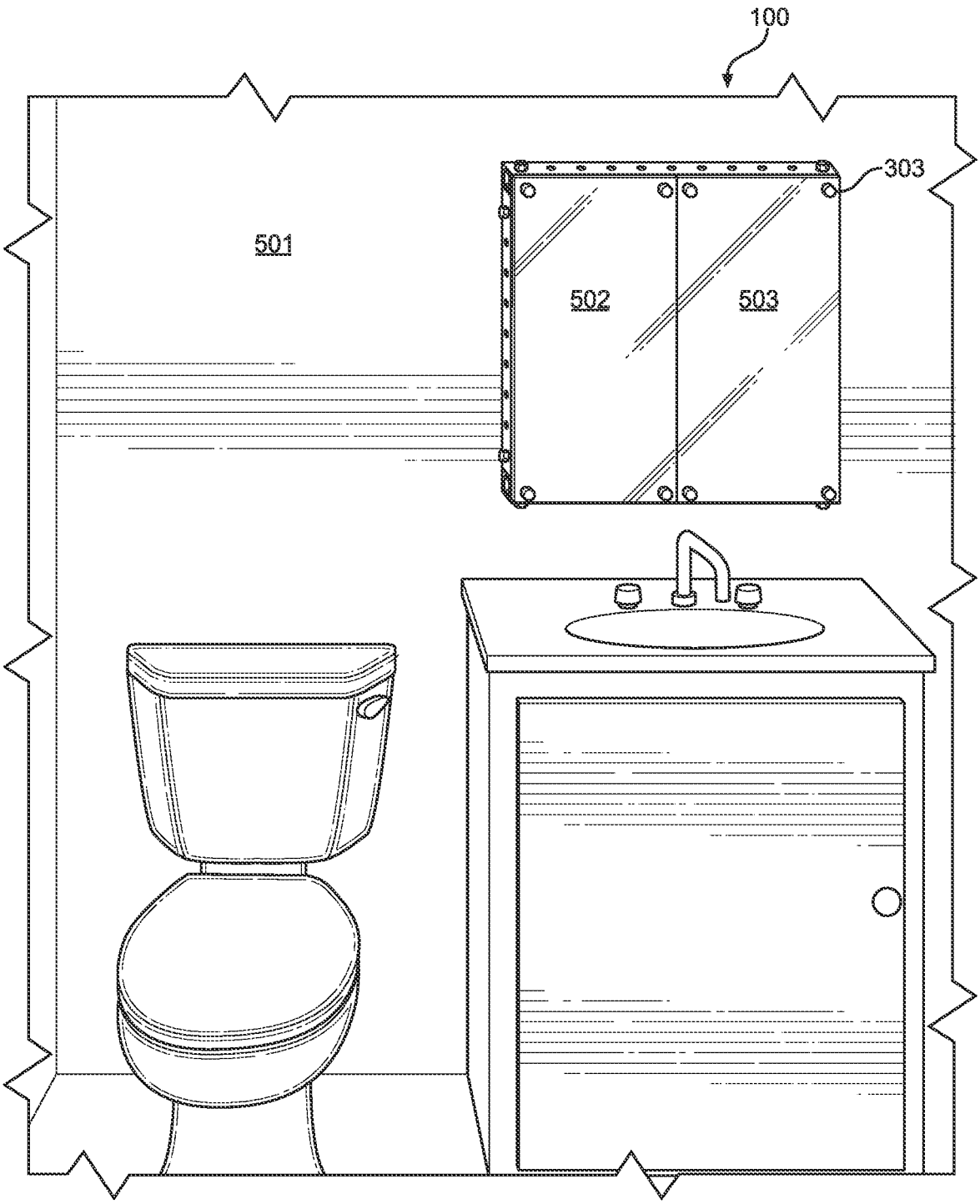
FIG. 5 shows a perspective view of an embodiment of a mirror attached to the frame.

Referring now to FIG. 5, there is shown a perspective view of an embodiment of a mirror attached to the frame. In one embodiment the mounting bracket 100 is secured to a vehicle. This will allow for the mirror to easily be secured for transport. In another embodiment the mounting bracket 100 is removably secured to a vehicle. This will allow for the mounting bracket 100 to be removed to easily transport the mirror to a desired location within a structure.

In another embodiment the mounting bracket 100 is secured to a wall of a structure 501. Fasteners are used to secure the mounting bracket 100 to the wall of the structure 501. Then a first mirror 502 is secured to the mounting bracket via decorative fasteners 303. A second mirror 503 is then secured flush against one side of the first mirror 502. This will allow the for simple installation of a multipart mirror.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular mirror frame, the frame comprising:

a first cross support secured to a plurality of elongated supports;

wherein the plurality of elongated supports are secured to a lower side face of the first cross support at a first end of each of the plurality of elongated supports;

wherein the plurality of elongated supports extends perpendicularly from the first cross support;

a second cross support is secured to a second end of each of the plurality of elongated supports, wherein the plurality of elongated supports are secured to an upper side face of the second cross support;

a plurality of mounting apertures is located through a front face and a rear face of each of the first cross support, the second cross support, and the plurality of elongated supports;

a plurality of supplemental apertures disposed through each side face of each of the first cross support, the second cross support, and the plurality of elongated supports;

a mirror secured to the frame, wherein the mirror has a plurality of apertures therethrough; and wherein the mirror is secured via mirror fasteners placed through the apertures of the mirror and the frame.

2. The modular mirror frame of claim 1, further comprising at least one additional cross support secured to the elongated supports between the first cross support and the second cross support.

3. The modular mirror frame of claim 2, further comprising at least one additional support affixed perpendicularly between adjacent cross supports.

4. The modular mirror frame of claim 1, wherein each of the supports has a rectangular cross section.

5. The modular mirror frame of claim 4, wherein each of the supports has an interior volume.

6. The modular mirror frame of claim 1, wherein each of the apertures of the plurality of mounting apertures and the plurality of supplemental apertures are threaded apertures.

7. The modular mirror frame of claim 6, wherein the mirror fasteners are threaded and correspond with the threaded apertures of the frame.

8. The modular mirror frame of claim 1, wherein the supports are removably secured together with fasteners.

9. The modular mirror frame of claim 1, further comprising a plurality of wheels secured to the first cross support.

10. The modular mirror frame of claim 1, wherein the mirror fasteners each comprise a decorative head.

* * * * *